US011498796B1

(12) United States Patent
Weatherford et al.

(10) Patent No.: US 11,498,796 B1
(45) **Date of Patent: *Nov. 15, 2022**

(54) STACKABLE WIRE-DISPENSING CONTAINER

(71) Applicant: Encore Wire corporation, McKinney, TX (US)

(72) Inventors: Benjamin L. Weatherford, Princeton, TX (US); William T. Bigbee, Jr., Melissa, TX (US); Clifton S. Thompson, Lucas, TX (US)

(73) Assignee: Encore Wire Corporation, McKinney, TX (US)

( * ) Notice: Subject to any disclaimer, the term of this patent is extended or adjusted under 35 U.S.C. 154(b) by 32 days.

This patent is subject to a terminal disclaimer.

(21) Appl. No.: 17/103,755

(22) Filed: Nov. 24, 2020

Related U.S. Application Data

(63) Continuation of application No. 16/789,365, filed on Feb. 12, 2020, now Pat. No. 10,875,737, which is a continuation of application No. 16/159,659, filed on Oct. 13, 2018, now Pat. No. 10,597,252, which is a continuation of application No. 15/394,606, filed on Dec. 29, 2016, now Pat. No. 10,131,515.

(60) Provisional application No. 62/273,926, filed on Dec. 31, 2015.

(51) Int. Cl.

| | |
|---|---|
| ***B65H 49/16*** | (2006.01) |
| ***B65H 49/08*** | (2006.01) |
| ***B65D 21/02*** | (2006.01) |
| ***B65D 85/04*** | (2006.01) |
| ***B65H 75/12*** | (2006.01) |

(52) U.S. Cl.
CPC ..... *B65H 49/16* (2013.01); *B65D 21/0209* (2013.01); *B65D 85/04* (2013.01); *B65H 49/08* (2013.01); *B65H 75/12* (2013.01); *B65H 2701/34* (2013.01)

(58) Field of Classification Search
CPC ..... B65H 49/08; B65H 49/16; B65H 49/328; B65H 75/12; B65H 2701/34; B65D 21/0209; B65D 85/04
See application file for complete search history.

(56) References Cited

U.S. PATENT DOCUMENTS

| | | | |
|---|---|---|---|
| 1,936,227 | A | 11/1933 | Cook |
| 2,620,997 | A | 12/1952 | Lyon |
| 2,634,922 | A | 4/1953 | Taylor |

(Continued)

OTHER PUBLICATIONS

Southwire Company, "Southwire's SIMpull® CoilPAK™ Payoff Revolutionizes the Construction Process", News Release, Mar. 28, 2013.

(Continued)

*Primary Examiner* — William E Dondero
(74) *Attorney, Agent, or Firm* — Warren Rhoades LLP

(57) ABSTRACT

An apparatus for dispensing wire or cable, the apparatus including an enclosure with a top and a bottom portion and at least three side portions of a first height, a plurality of holes located in both the top and bottom portions of the enclosure, and a core of a second height located within the enclosure, wherein the core forms an area, wherein at least one of the plurality of holes has a first hole diameter and is located in the top and bottom of the enclosure and is located within the area formed by the core, and wherein the wire or cable is placed around the core.

10 Claims, 6 Drawing Sheets

(56) References Cited

U.S. PATENT DOCUMENTS

| | | | | |
|---|---|---|---|---|
| 2,716,008 | A | 8/1955 | Taylor | |
| 2,738,145 | A | 3/1956 | Taylor | |
| 3,390,844 | A | 7/1968 | Dillow | |
| 3,406,817 | A | 10/1968 | Feaster | |
| 3,602,455 | A * | 8/1971 | Lewis | B65H 49/08 242/129 |
| 3,853,223 | A | 12/1974 | Nowlain | |
| 3,982,712 | A | 9/1976 | Bassett | |
| 4,664,260 | A | 5/1987 | Stokes | |
| 5,201,419 | A | 4/1993 | Hayes | |
| 5,413,264 | A | 5/1995 | Kotzur et al. | |
| 5,470,026 | A | 11/1995 | Kotzur | |
| 5,529,186 | A | 6/1996 | Bass | |
| 5,678,778 | A | 10/1997 | Kotzur et al. | |
| 5,803,394 | A | 9/1998 | Kotzur et al. | |
| 5,810,272 | A | 9/1998 | Wallace et al. | |
| 5,979,812 | A | 11/1999 | Kotzur et al. | |
| 6,016,911 | A | 1/2000 | Chen | |
| 6,086,012 | A | 7/2000 | Kotzur et al. | |
| 6,109,554 | A | 8/2000 | Kotzur et al. | |
| 6,276,623 | B1 | 8/2001 | Williams | |
| 6,341,741 | B1 | 1/2002 | Kotzur et al. | |
| 6,491,163 | B1 | 12/2002 | Grcic et al. | |
| 6,702,213 | B2 | 3/2004 | Kotzur et al. | |
| 6,766,627 | B2 | 7/2004 | Kotzur et al. | |
| 7,007,799 | B2 | 3/2006 | Cote | |
| 7,032,854 | B2 | 4/2006 | Marsden | |
| 7,100,346 | B2 | 9/2006 | Kotzur et al. | |
| D541,145 | S | 4/2007 | Copp | |
| 7,198,151 | B1 | 4/2007 | Fomby | |
| 7,249,726 | B2 | 7/2007 | Kotzur | |
| 8,006,840 | B2 | 8/2011 | Babcock et al. | |
| 8,191,337 | B2 | 6/2012 | Moore | |
| 8,251,212 | B2 | 8/2012 | Dunlap | |
| 8,783,601 | B1 | 7/2014 | Shala | |
| 8,794,438 | B2 | 8/2014 | Copp et al. | |
| 8,944,358 | B2 | 2/2015 | Copp et al. | |
| 8,960,431 | B2 | 2/2015 | Copp et al. | |
| 9,010,532 | B2 | 4/2015 | Nicklas | |
| 9,027,313 | B2 | 5/2015 | Copp et al. | |
| 9,061,814 | B2 | 6/2015 | Copp et al. | |
| 9,776,826 | B2 | 10/2017 | Moore et al. | |
| 10,124,982 | B1 | 11/2018 | Rhoads et al. | |
| 10,597,252 | B1 * | 3/2020 | Weatherford | B65D 85/04 |
| 10,625,974 | B1 | 4/2020 | Rhoads et al. | |
| 10,875,737 | B1 * | 12/2020 | Weatherford | B65H 49/08 |
| 2004/0026284 | A1 | 2/2004 | Cote | |
| 2004/0206652 | A1 | 10/2004 | Barton et al. | |
| 2005/0224381 | A1 * | 10/2005 | Bae | B23K 9/133 206/409 |
| 2006/0196989 | A1 | 9/2006 | Bartley et al. | |
| 2007/0051649 | A1 | 3/2007 | Carroscia | |
| 2007/0075171 | A1 | 4/2007 | Babcock et al. | |
| 2009/0020569 | A1 | 1/2009 | Young | |
| 2009/0057459 | A1 | 3/2009 | Fabian | |
| 2010/0320310 | A1 | 12/2010 | McManus et al. | |
| 2013/0001238 | A1 | 1/2013 | Burke | |
| 2013/0087652 | A1 | 4/2013 | Chastain et al. | |
| 2013/0140396 | A1 | 6/2013 | Gupta | |
| 2013/0146696 | A1 | 6/2013 | Copp et al. | |
| 2013/0284851 | A1 | 10/2013 | Copp et al. | |
| 2014/0061361 | A1 | 3/2014 | Marble | |
| 2014/0158802 | A1 | 6/2014 | Batchelder et al. | |
| 2014/0262891 | A1 | 9/2014 | Babcock | |
| 2014/0326624 | A1 | 11/2014 | Copp et al. | |
| 2014/0326625 | A1 | 11/2014 | Copp et al. | |
| 2016/0101962 | A1 | 4/2016 | Moore et al. | |
| 2017/0043974 | A1 | 2/2017 | Moore | |

OTHER PUBLICATIONS

Southwire Company, "Southwire's SIMpull® CoilPAK™ Payoff Earns NECA Showstopper Award, the Latest Honor for Revolutionizing the Construction Process", News Release, Oct. 23, 2013.

Southwire Company, "SIMpull CoilPAK Payoff", product insert, 2013.

* cited by examiner

STACKABLE WIRE-DISPENSING CONTAINER

CROSS-REFERENCE TO RELATED APPLICATIONS

This application is a continuation of U.S. patent application Ser. No. 16/789,365, filed Feb. 12, 2020, now issued as U.S. Pat. No. 10,875,737, issued Dec. 29, 2020, which is a continuation of U.S. patent application Ser. No. 16/159,659, filed Oct. 13, 2018, now issued as U.S. Pat. No. 10,597,252, issued Mar. 24, 2020, which is a continuation of U.S. patent application Ser. No. 15/394,606, filed Dec. 29, 2016, now issued as U.S. Pat. No. 10,131,515, issued Nov. 20, 2018, which claims priority benefit to U.S. Provisional Patent Application No. 62/273,926, filed Dec. 31, 2015, all of which are hereby incorporated by reference herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present invention relates in general to electrical wire and cable, and more particularly, to the stackable wire dispensing containers.

2. Description of Related Art

Wooden reels or plastic and metal spools are common in the wire and cable industry for winding circuit-size wire. Once wound, the reels and spools are distributed to customers for use at jobsites. Wound reels and spool are often heavy, cumbersome and difficult to carry while on the jobsite due to a lack of a handle. External conditions may also impact the reliability of the reel or spool. For example, in wet conditions, wooden reels act as wicks, absorbing water, and becoming heavier. The reels and spools are prone to damage, such as splintering or shattering, if dropped by the customer. Once damaged, the wire or cable being paid off may become tangled or damaged by the damaged reel or spool as the wire is removed or paid off in a last on/first off format. Reels and spools often require jack stands and a shaft to support the reel or spool during pay-off. The customer must transport and use this additional equipment when dispensing wire or cable from the reel or spool. Additional pulling force is also needed to rotate the entire weight of the reel and its contents during payoff. During payoff, the inertia of the reel or spool may cause the reel or spool to continue to rotate after pulling has ceased, causing "overruns" which increase the risk of tangles and snags and additional damage to the wire or cable.

Prior art containers for dispensing wire without reels or spools include Encore Wire Corporations' co-pending U.S. patent application Ser. No. 14/731,021 entitled "SYSTEM AND APPARATUS FOR WIRE AND CABLE PACKAGING AND PAYOFF" which discloses a system and apparatus for improved wire and cable packaging and payoff. The wire or cable is coiled in a FIG. 8 pattern and includes an embedded payoff port. The system and apparatus allow the wire to be pulled from the inner diameter of the core rather than the outer diameter along substantially the same axis as the direction of the payoff wire and cable. The coil does not need to move to pay-off and therefore pulling force is minimal. The packaging used to contain the coils eliminates the possibility of tangles or overruns. Another prior art container includes shrink-wrapped wire coils which are typically used for retail distribution of residential wire.

Another prior art container for packaging coils of wire or cable without a spool or reel is the barrel pack. The barrel pack, however, has several disadvantages. For example, the barrel pack has large and significant size and weight characteristics. A traditional barrel pack cannot easily be moved by hand because it weighs several hundred pounds and must be moved with a dolly or machinery.

Therefore, there is a need in the art for an apparatus that is compact, easily transportable, stackable, and capable of spooling several wires while conveniently stacked in any number on the ground or any other surface.

BRIEF SUMMARY OF THE INVENTION

The present invention provides for a stackable wire dispensing container. The stackable wire dispensing container contains a coil of wire and allows the wire to be dispensed without requiring the rotation of the entire coil and package. The removal of the need to rotate the entire reel or spool significantly reduces the pulling force needed to dispense the wire. The stackable wire dispensing container includes a handle or handles to provide ease in transporting or carrying the stackable wire dispensing container containing the wire. Finally, the stackable wire dispensing container may be conveniently stacked in any number for convenient payoff of several wires or wire types or sizes simultaneously or during the same wire pull by the user. The stackable wire dispensing container is advantageous over prior art containers due to the containers' high total footage capacity and typically lower cost as a wide variety of materials may be used in the manufacture of the stackable wire dispensing container without detracting from the spirit of the invention, including less expensive materials. Further, the stackable wire dispensing container uses a standard coiling machine and does not require a FIG. 8 pattern of coiling of wire. Additionally, the stackable wire dispensing container removes the need to unwrap or cut the shrink-wrap to dispense the wire. When cutting a shrink-wrapped coil, it is easy to make a hole that is too large and will compromise the stability of the coil. The precut payoff holes of the stackable wire dispensing container provide more stability and convenience.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

Figure 1:
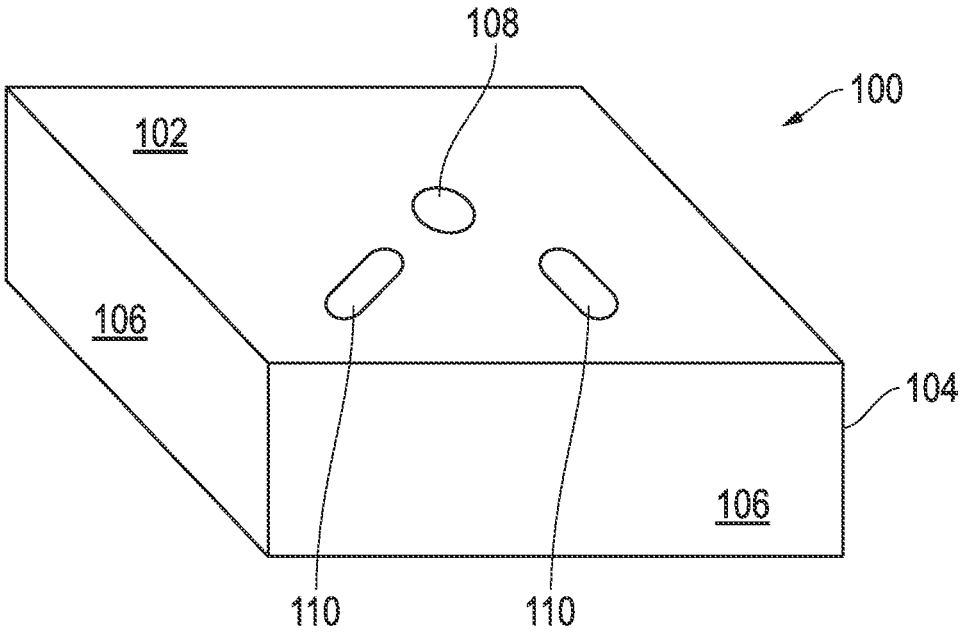
FIG. 1 is a perspective view of the stackable wire dispensing container according to one embodiment of the invention.
Figure 2:
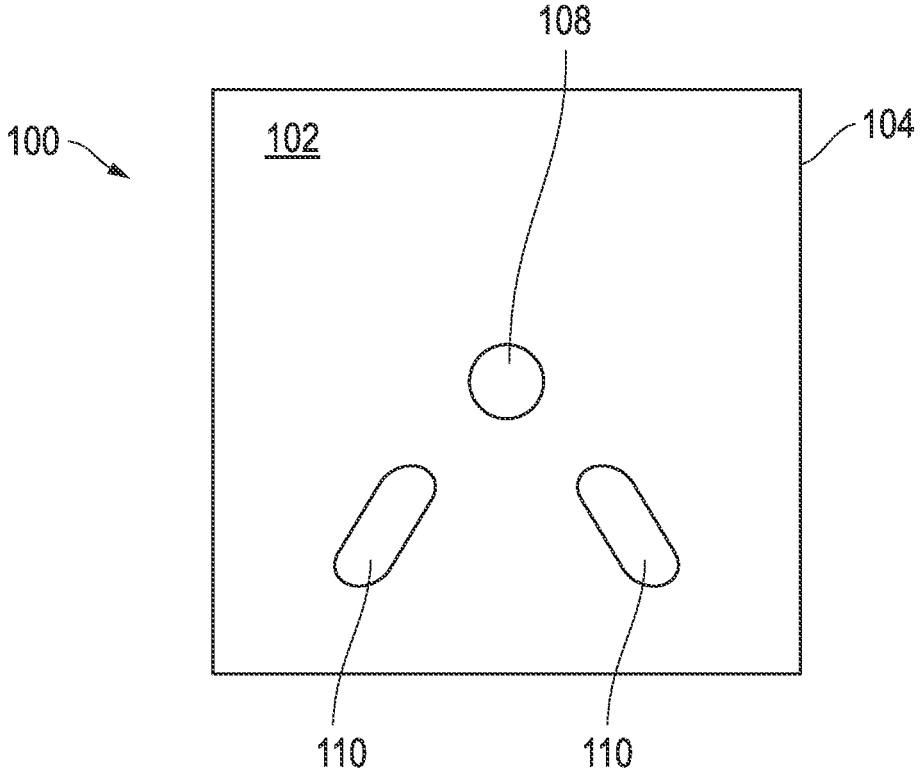
FIG. 2 is a top view of a stackable wire dispensing container according to one embodiment of the invention.
Figure 3:
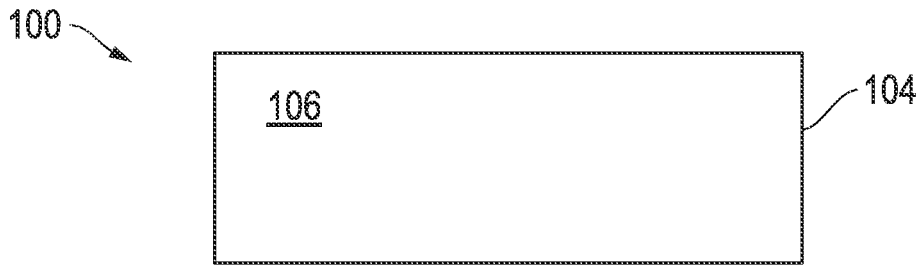
FIG. 3 is a side view of a stackable wire dispensing container according to one embodiment of the invention.
Figure 4:
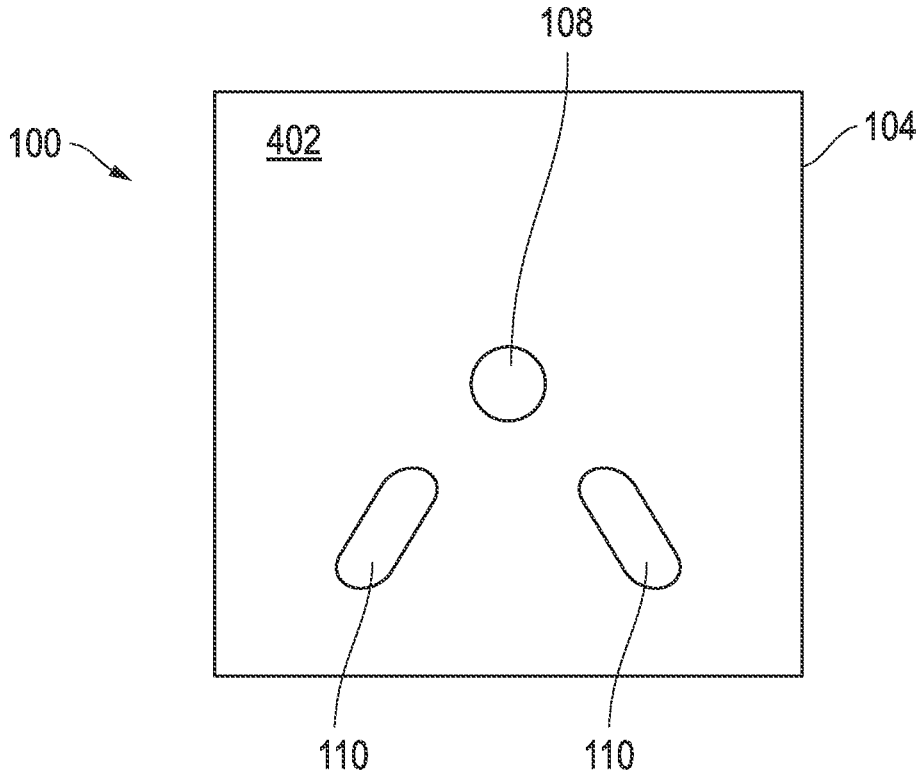
FIG. 4 is a bottom view of a stackable wire dispensing container according to one embodiment of the invention.
Figure 5:
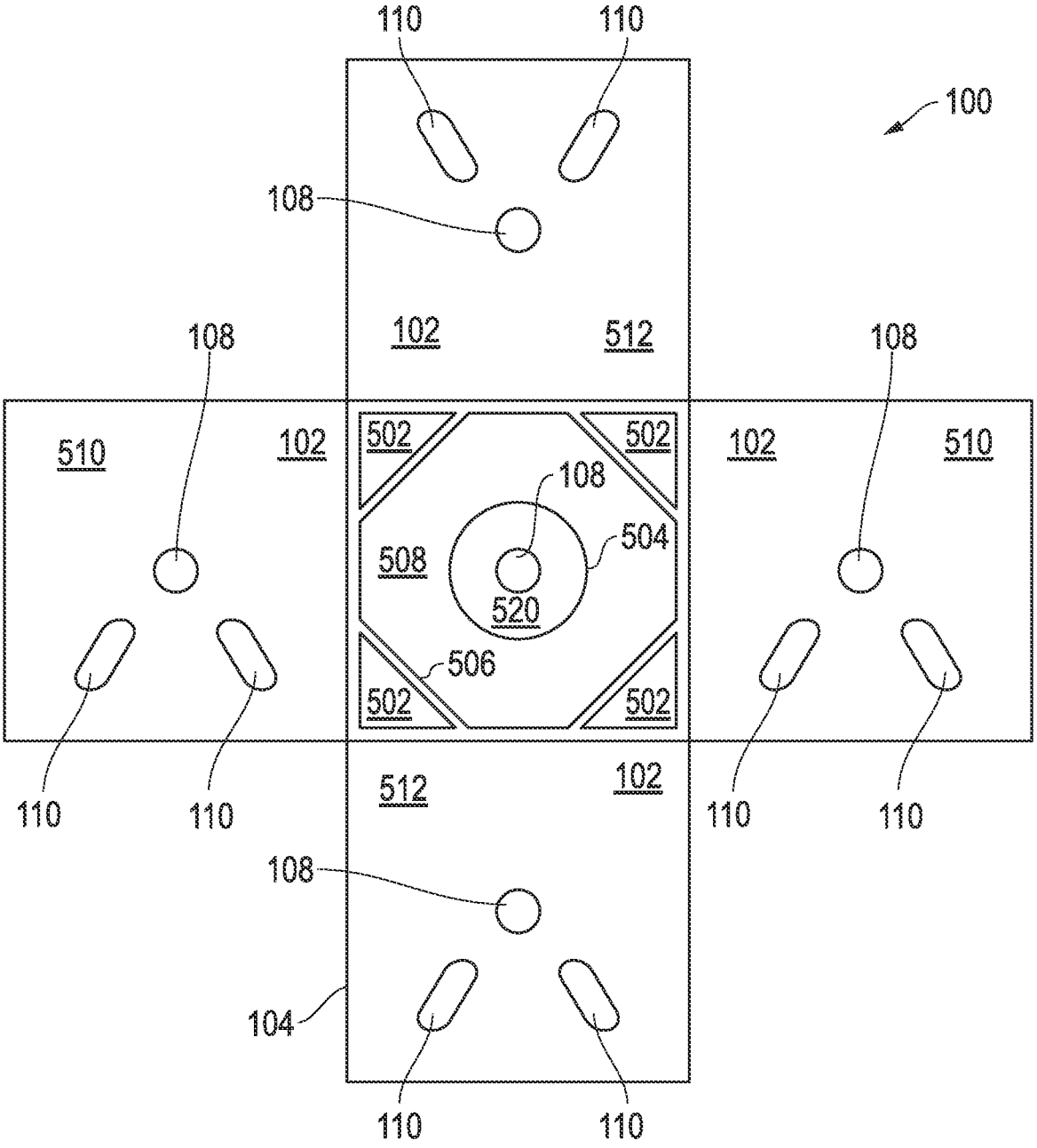
FIG. 5 is a top view of an open stackable wire dispensing container according to one embodiment of the invention.
Figure 6A:
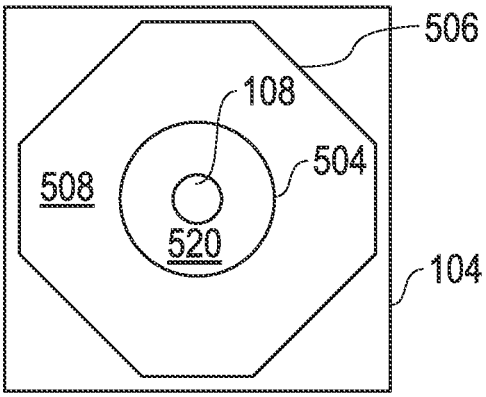
FIGS. 6*a*-6*b* are top views of a core and exterior wall of a stackable wire dispensing container according to one embodiment of the invention.
Figure 6B:
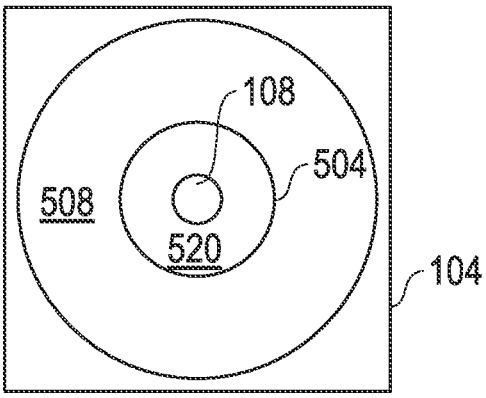

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE PREFERRED EMBODIMENT

The following discussion is presented to enable a person skilled in the art to make and use the present invention. The general principles described herein may be applied to embodiments and applications other than those specifically detailed below without departing from the spirit and scope of the present invention. Therefore, the present invention is not intended to be limited to the embodiments expressly shown, but is to be accorded the widest possible scope of invention consistent with the principles and features disclosed herein.

Referring to FIGS. 1-7 by way of non-limiting example, and consistent with embodiments of the invention, a stackable wire dispensing container 100 is shown. According to one embodiment of the invention, a stackable wire dispensing container 100 includes three components—a box enclosure 104, a core 504, and support elements 502. In one embodiment, the box enclosure 104 is formed by a single sheet of corrugated cardboard, which is appropriately cut and provided with folding creases. The box enclosure 104 and the stackable wire dispensing container 100 and all elements thereof, however, may be formed from multiple pieces attached together with attachment mechanisms known to those skilled in the art without detracting from the spirit of the invention, including but not limited to, a box with a separate top and may be formed from a variety of materials, including but not limited to, corrugated cardboard, without detracting from the spirit of the invention. Further, in one embodiment, the box enclosure 104 is substantially rectangular or square and includes a top portion 102, a bottom portion 402 and four side walls 106. In this embodiment, the box enclosure 104 includes a top portion 102 formed from folding two inner closure flaps 510 carried by opposite side walls 106, and two outer closure flaps 512 carried by the front and rear side walls 106. The box enclosure 104 has a bottom portion 402 formed in the same manner as the top portion 102. In one embodiment, the box enclosure 104 is constructed entirely from corrugated cardboard, however, a wide variety of package materials may be used without detracting from the spirit of the invention.

In one embodiment, the box enclosure 104 includes slot-shaped cutouts 110 in the top portion 102 and the bottom portion 402 and a circular hole 108 cut into the center of the top portion 102 and bottom portion 402. The circular holes 108 of both the top portion 102 and the bottom portion 402 align on a vertical axis of the stackable wire dispensing container 100. In one embodiment, the slot-shaped cutouts 110 and the circular hole 108 are present in each of the two inner closure flaps 510 and two outer closure flaps 512 of the top portion 102 and bottom portion 402 of the box enclosure 104. The slot-shaped cutouts 110 may be used as handles for carrying the stackable wire dispensing container 100. The wire contained in the stackable wire dispensing container 100 is dispensed through the circular hole 108. The circular hole 108 is present on both the top and bottom of the stackable wire dispensing container 100 so that multiple stackable wire dispensing containers 100 may be stacked on top of each other and the wire from each stackable wire dispensing container 100 may be pulled through the circular holes 108 and out the top of the highest stackable wire dispensing container 100. This allows for the wire from a stackable wire dispensing container 100 on a lower level of the stack to be dispensed simultaneously with the wire from higher stackable wire dispensing containers 100 by dispensing or pulling all the wires through a column formed by the holes 108.

A core 504 is included within the stackable wire dispensing container 100. In one embodiment, the core 504 is a substantially hollow cylinder of a height less than the height of the side walls 106. The core 504 forms an inner core portion 520 and an outer core portion 508. The inner core portion 520 includes the circular hole 108 typically near the center of the inner core portion 520. The outer core portion 508 is the area outside of the core 504. The outer core portion 508 may be bound by the sides 106 or, in one embodiment, by an exterior wall 506. The exterior wall 506 is located within the box enclosure 104 and surrounds the core 504 forming the outer core portion 508. The exterior wall 506 has a height equal to or less than the height of the side 106. The exterior wall 506 may have a height equal to the height of the core 504, however, a wide variety of heights may be implemented without detracting from the spirit of the invention. In one embodiment, the exterior wall 506 is substantially circular. In another embodiment, the exterior wall 506 is substantially hexagonal. A wide variety of exterior wall 506 shapes may be implemented without detracting from the spirit of the invention. In the embodiments with the exterior wall 506, support elements 502 may be located in the corners of the box enclosure 104 to provide support for the stackable wire dispensing container 100. In one embodiment, the support elements 502 are substantially triangular. In another embodiment, the support elements 502 are substantially triangular with one face curved to conform to a substantially circular exterior wall 506. A wide variety of support element 502 shapes and sizes may be implemented without detracting from the spirit of the invention. Wire or cable is placed in the outer core portion 508 for transportation and dispensing.

Figure 7:
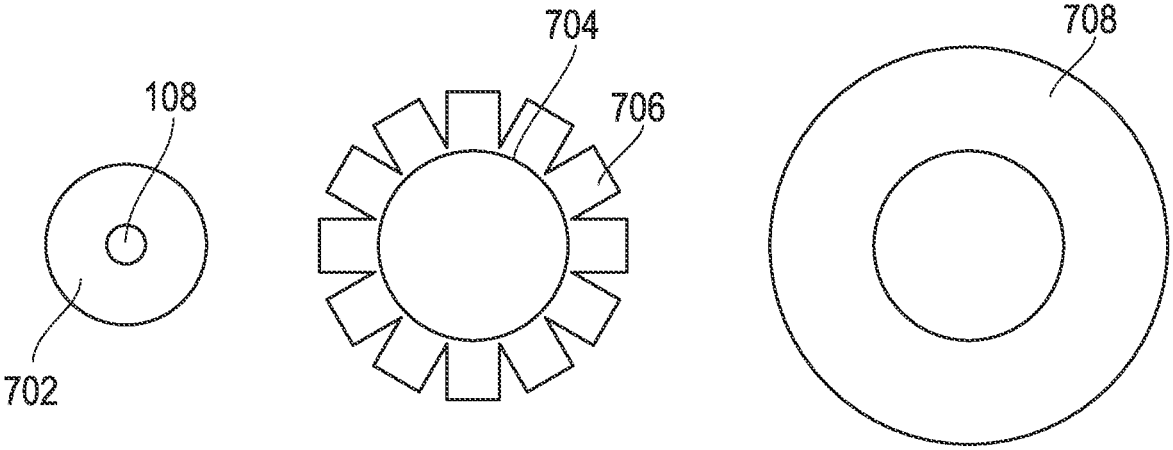
FIG. 7 is a top view of a disassembled core of a stackable wire dispensing container according to one embodiment of the invention.
Figure 8A:
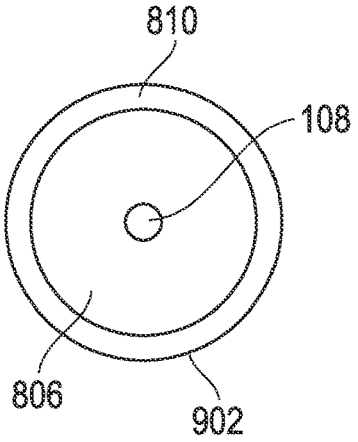
FIGS. 8*a*-8*b* are top views of a mini-barrel stackable wire dispensing container according to one embodiment of the invention.
Figure 8B:
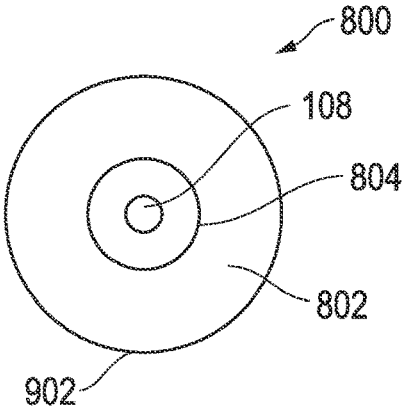
Figure 9:
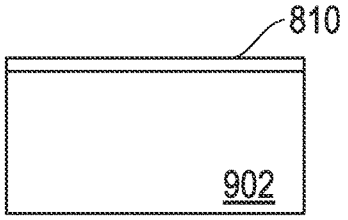
FIG. 9 is a side view of a mini-barrel stackable wire dispensing container according to one embodiment of the invention.
Figure 12A:
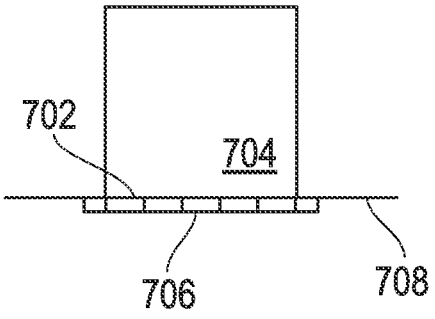
FIGS. 12*a*-12*b* are side views of the core of a stackable wire dispensing container according to one embodiment of the invention.
Figure 12B:
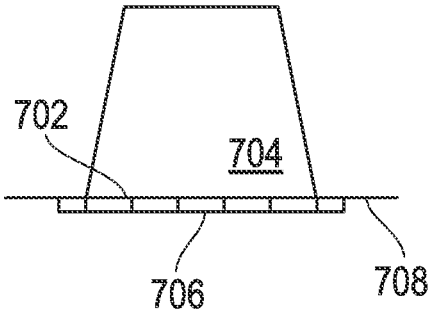

Referring now to FIGS. 7 and 12*a*-*b*, an unassembled core according to one embodiment of the invention is shown. In one embodiment, a center plate 702 including the circular hole 108 is shown. The center plate 702 is placed in side of the core 704. The core 704 includes flaps 706 to provide support to the core 704. The flaps 706 are located at the bottom of the core 704 and are either formed from a continuous piece of material or are attached to core 704 through attachment mechanism known to those skilled in the art. An outside plate 708 is placed over the core 704 and flaps 706. The outside plate 708 includes an opening substantially the same size and shape as the core 704. The outside plate 708 and center plate 702 restrict movement of the core 704 and maintaining the common vertical axis of the circular holes 108. In one embodiment, the outside plate 708 forms the bottom portion of the outer core portion 508. In one embodiment, the purpose of the outer core portion 508 and the core 504 or core 704 is to contain the coil of cable or wire and keep it from collapsing upon itself, eliminating or reducing wire or cable tangles. Various core shapes and sizes may be implemented without detracting from the spirit of the invention, including but not limited to, cylindrical or conical. An assembled cylindrical core 704 is shown in FIG. 12*a*. An assembled conical core 704 is shown in FIG. 12*b*. The assembled conical core 704 has a wider diameter at the bottom of the core 704 and a narrower diameter at the top of the core 704. The outside plate 708 is shown overlapping the flaps 706 of the core 704 in FIGS. 12*a-b*.

Figure 11:
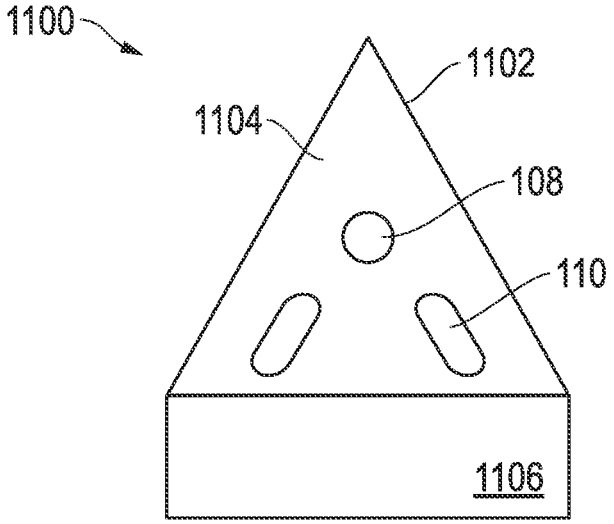
FIG. 11 is a perspective view of a stackable wire dispensing container according to one embodiment of the invention.

FIG. 11 refers to a stackable wire dispensing container according to one embodiment of the invention. In this embodiment, the shape of the stackable wire dispensing container 1100 is substantially triangular. In this embodiment, the stackable wire dispensing container 1100 includes a triangular box enclosure 1102. The triangular box enclosure 1102 includes three sides 1106, a top 1104, a bottom (not shown), the circular hole 108 and the slot-shaped cutouts 110. The core 504, inner core portion 520, outer core portion 508, exterior wall 506, and support elements 502 as discussed herein function the same in this stackable wire dispensing container 1100 embodiment. Further, a wide variety of stackable wire dispensing container shapes and sizes may be implemented without detracting from the spirit of the invention. In this embodiment, the wire or cable is located in the outer portion 508, around the core 504, and is dispensed through the hole 108. Stackable wire dispensing containers 100 or 1100 of various shapes and sizes may be stacked upon each other as long as the circular holes 108 are maintained upon a common vertical axis and wire or cable may be dispensed from all of the stacked stackable wire dispensing container 100 or 1100 through the circular holes 108.

A fully assembled stackable wire dispensing container 100, according to one embodiment of the invention, includes dimensions of 24"×24"×10", however, a wide variety of shapes, sizes and dimensions of the stackable wire dispensing container may be implemented without detracting from the spirit of the invention.

Figure 10:
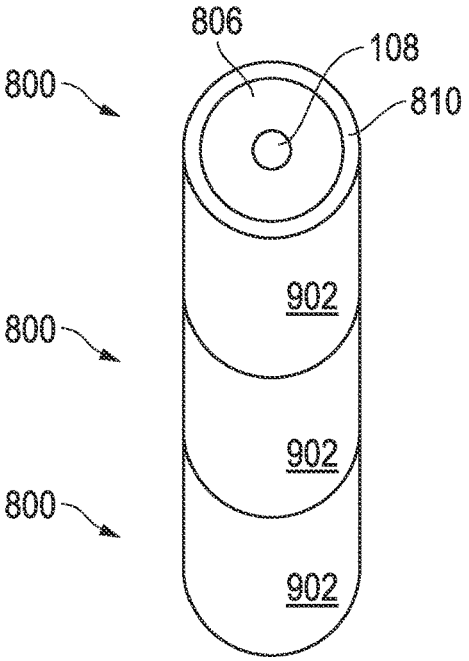
FIG. 10 is a perspective view of multiple mini-barrel stackable wire dispensing containers stacked together according to one embodiment of the invention.

Referring now to FIGS. 8*a*-10, a mini-barrel wire or cable container according to one embodiment of the invention is shown. In one embodiment, the mini-barrel container 800 includes four major components—a mini barrel enclosure 902, a removable lid 806, a clamping ring 810, and a core 804. The mini barrel container 800 is cylindrical. A traditional prior art barrel pack for wire and cable is approximately 23" inches in diameter and typically has a height of 40" or greater. In one embodiment, the mini-barrel enclosure 902, has a 23" diameter or a diameter equal to the prior art barrel pack diameter. The mini-barrel enclosure 902, however, has a height of approximately 10". As with other embodiments of the stackable wire dispensing container 100, the mini-barrel container 800 is stackable and includes a circular hole 108 in the center of the removable lid 806 and the bottom plate 802. In an embodiment of stacked mini-barrel containers 800, as shown in FIG. 10, the circular holes 108 are located on a common vertical axis and allow simultaneous payoff or wire dispensing from multiple stacked mini-barrel containers 800. The core 804 is substantially identical to the cores discussed herein, including the formation of an area to contain the wire or cable. The removable lid 806 is attachable to the mini-barrel container 800 with the clamping ring 810. In one embodiment, the clamping ring 810 includes an upper lip to secure another mini-barrel container 800 stacked upon it facilitating secured nesting of multiple mini-barrel containers 800. Additionally, in one embodiment, the clamping ring 810 may be the same ring as used on traditional barrel packs. The clamping ring 810 fits on the metal rings attached to the fiber drum of the barrels. In one embodiment, the clamping ring 810 is metallic, however, a wide variety of materials may be used in forming the clamping ring without detracting from the spirit of the invention.

It is typical to ship multiple, parallel conductors within one traditional barrel pack. Dispensing the wires from these traditional barrel packs requires extensive user interaction. One advantage of the mini-barrel container 800 is the wire may be lifted and moved by hand because the mini-barrel container 800 is a more manageable size and weight. In one embodiment of the invention, the mini-barrel removable lid 806 includes slot-shaped cutouts (not shown) to be used as handles for movement of the mini-barrel containers 800. The mini-barrel containers 800 also provide the electrical installer more flexibility versus a paralleled barrel pack. With a paralleled barrel pack the installer is forced to dispense all the included conductors simultaneously while dispensing the same length for each conductor. With multiple mini-barrel containers 800, the installer has the option of dispensing all conductors simultaneously or dispensing each conductor for a different length.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

One skilled in the art will recognize that different embodiments may be formed in a similar manner having different characteristics depending upon need, performance, or some other criteria. It will thus be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

What is claimed is:

1. An apparatus for dispensing wire or cable, the apparatus comprising:

a cylindrical enclosure, wherein the cylindrical enclosure has a bottom portion and a top portion;

a wire hole located in both the top and bottom portions of the enclosure;

a carrying hole located in the bottom portion of the enclosure; and wherein the wire or cable exits the wire hole in the top portion.

2. The apparatus of claim 1, wherein the enclosure is cardboard.

3. The apparatus of claim 1, wherein the wire holes in both the top and bottom portions of the enclosure are on the same vertical axis.

4. The apparatus of claim 1, wherein the top portion of the enclosure is removable.

5. The apparatus of claim 4 further comprising a clamping ring removably attached to the top portion of the cylindrical enclosure.

6. A system for dispensing wire or cable, the system comprising:

a first wire dispensing apparatus including a first wire;

a second wire dispensing apparatus including a second wire and located on top of the first wire dispensing apparatus;

wherein the first and second dispensing apparatus each comprise:

a cylindrical enclosure, wherein the cylindrical enclosure has a bottom portion and a top portion;

a wire hole located in both the top and bottom portions of the enclosure;

a carrying hole located in the bottom portion of the enclosure; and wherein the wire or cable exits the wire hole in the top portion.

7. The system of claim 6 further comprising a clamping ring removably attached to the top portion of the cylindrical enclosure.

8. The apparatus of claim 7, wherein the clamping ring comprises an upper lip to attach to the bottom portion of the second wire dispensing apparatus.

9. The system of claim 7, wherein the clamping ring is attached to the top portion of the first wire dispensing apparatus and attached to the bottom portion of the second wire dispensing apparatus.

10. The system of claim 6, wherein the first wire passes through the wire hole of both the top and bottom portion of the second wire dispensing apparatus enclosure.

* * * * *